United States Patent [19]

Okuyama et al.

[11] 4,419,017

[45] Dec. 6, 1983

[54] ELECTRONIC CLOCK

[75] Inventors: Yasuhiko Okuyama; Takashi Takezono, both of Gunma, Japan

[73] Assignees: Sanyo Electric Co., Ltd., Osaka; Tokyo Sanyo Electric Co., Ltd., Gunma, both of Japan

[21] Appl. No.: 254,072

[22] Filed: Apr. 14, 1981

[30] Foreign Application Priority Data

Apr. 24, 1980 [JP] Japan ..... 55-54971

[51] Int. Cl.[3] ..... G04B 1/00

[52] U.S. Cl. ..... 368/64; 368/48; 368/66; 368/155; 368/156; 368/157

[58] Field of Search ..... 368/48, 64, 66, 155, 368/156, 157

[56] References Cited

U.S. PATENT DOCUMENTS 3,902,311 9/1975 Chacon et al. ..... 368/48 X
3,998,043 12/1976 Tamaru et al. ..... 368/66
4,032,864 6/1977 Yamashiro et al. ..... 368/156 X
4,040,247 8/1977 Haydon ..... 368/156

FOREIGN PATENT DOCUMENTS 2344823 5/1974 Fed. Rep. of Germany ..... 368/64

*Primary Examiner*—Ulysses Weldon
*Attorney, Agent, or Firm*—Armstrong, Nikaido, Marmelstein & Kubovcik

[57] ABSTRACT

A plug-in electronic clock being operated either by a commercial power source in a normal state or by a D.C. power source in case of a power failure, said electronic clock having means for generation of a pulse train used for a computation of time information in case of a power failure and means for stopping generation of the said pulse train in a case where the commercial power is active so as to prevent interference noise against radio receivers or television receivers, with a correct time information computation being assured when the commercial power source is recovered.

8 Claims, 21 Drawing Figures

ELECTRONIC CLOCK

The present invention relates to a plug-in electronic clock, and more particularly to a power-failure-proof electronic clock operated by either a first standard pulse train having a frequency derived from the oscillations of commercially supplied power or a second oscillator generated standard pulse train used for generation of time information during a power failure.

In a simple electronic clock employing an oscillating commercial power source as the normal power source and using a first standard pulse train of commercial frequency from the oscillations of the commercial power, time information cannot be computed when the commercial power is lost, as in a power failure, causing an incorrect time display. Therefore, in order to avoid the drawbacks, such clocks are sometimes adapted to be driven by an emergency power source such as a battery with the time information being computed on the basis of a second standard frequency provided from an accurate, relatively high frequency auxiliary oscillator circuit. But if the auxilliary oscillator is of high frequency, it produces interference noise in nearby television or radio receivers. This noise is particularly a problem in the case where even after commercial power is recovered the high frequency auxiliary oscillator is left running.

The drawbacks mentioned above will be apparent in detail by the following description made with reference to the drawings in which FIG. 1 is a schematic diagram showing one example of a conventional plug-in electronic clock that can run during a power failure.

FIGS. 2*a* to 2*e* are various wave forms showing the operation of the conventional circuit arrangement shown in FIG. 1 when commercial power is being supplied.

FIGS. 3*a* to 3*h* are various wave forms showing the operation of the circuit arrangement of FIG. 1 in a case where the commercial power fails and then is later recovered.

Referring to FIGS. 1 and 2, a first standard pulse train f1 having a commercial power source frequency derived from the oscillations of an AC commercial power source is applied to a first flip-flop 2 of D type to which the second standard pulse train f2 is clocked so that the flip-flop 2 generates an output s2 synchronised to change state with the trailing edge of one of the pulses of the second standard pulse train f2 when the first standard pulse train is at a high level or "1" signal state as shown in FIG. 2(*c*).

The output of first flip-flop 2 is applied to a second flip-flop 4 of D type to which the second standard pulse train f2 is clocked so that flip-flop 4 generates an output as shown in FIG. 2*d* synchronized to change state with the trailing edge of a pulse of the second standard pulse train occurring just after the output of the flip-flop 2 has become a "1".

The output of flip-flop 4 is supplied to one of the inputs of the AND gate 6 through an inverter 7. The output of flip-flop 2 is applied to the second input of AND gate 6 so that AND gate 6 produces one pulse PU (See FIG. 2*e*) for each cycle of the first standard pulse train f1. The output of AND gate 6 is supplied to the reset input of a flip-flop 8. The output of flip-flop 8 is applied to an AND gate 10 through an inverter 12. AND gate 10 receives the first standard pulse train f1 at its second input terminal so that AND gate 10 allows the first standard pulse train f1 to pass to a time counter or computing circuit 14 through an OR gate 16 when flip-flop 8 is reset. Thus the time computing circuit 14 counts up the first standard pulses f1 to provide time information representing the hour, minute and second if the first standard pulses are available, i.e., the commercial power source is active. A display device 18 fed by the counter displays the time information in digital form with the hours' minutes' and seconds' units varying with time in a known manner.

In order to continue to provide accurate time information in case of a power failure, a frequency divider 20 receives a second standard pulse train f2, dividing its frequency to replicate the normal frequency of the lost commercial power, e.g., 60 cycles second (60 Hz). However, frequency divider 20 is adapted to receive the pulse PU at its two reset input terminals RO from the AND gate 6 so that the contents of frequency divider 20 are reset to zero every time the pulse PU is generated. This zeroing means that the divided frequency time information of the second standard pulse is not obtained from the frequency divider 20 when the commercial power source is active. However, in case of commercial power failure the first standard pulse train f1 disappears. Thus, no pulse PU is generated from AND gate 6 to reset the frequency divider 20.

Therefore, the frequency divider 20 produces a 60 Hz train of output pulses one pulse for every time divider 20 counts up a predetermined number of the second standard pulses f2. The output of the frequency divider 20 is applied to a differrential circuit 22 to provide differentiated pulses f3 which are applied to the reset input of flip-flop 8 to reset the same.

When flip-flop 8 is reset, its output $\overline{Q}$ becomes a high level or "1" signal state, disabling AND gate 10 and enabling AND gate 24 to pass the 60 Hz outputs of frequency divider 20 to the time computing circuit 14 through OR gate 16. In this way the clock can continue to display the time by the display device 18 even if the commercial power is lost.

In the conventional electronic clock as mentioned above, the second standard pulse train f2 always occurs even if the commercial power is active. Therefore, when such an electronic clock is used adjacent to or in combination with a radio or television receiver the second standard pulse train f2 gives noise to the receiver.

One way of avoiding the noise problem is to eliminate the second standard pulse train f2 when the commercial power source is active. However, this method gives rise such a disadvantage as described below. In the electronic clock shown in FIG. 1, when the commercial power is recovered from power failure, the flip-flop 2 becomes high level or "1" in synchronism with the trailing edge of a pulse of the second standard pulse train f2 occurring just after the commercial power is recovered as shown in FIG. 3. In turn the output of the flip-flop 4 becomes high level or "1" by a delay of one pulse of the second standard frequency so that the pulse PU can be generated to reset the flip-flop 8. Then AND gate 10 allows the first standard pulse train to pass to counter 14 so that the clock operates normally again. But if the second standard pulse train f2 was adapted to occur only during power failure, when the commercial power recovered the second standard pulse train f2 would be stopped. Then both flip-flops 2 and 4 would not produce a high level or "1" signal in spite of the application of the first standard pulses to flop-flop 2, thereby disabling AND gate 6, from producing pulse PU. Thus flip-flop 8 would not be reset and the output of inverter 12 would remain at low level or "0", disabling AND gate 10 from applying the first standard pulse f1 to the time computing circuit 14 through OR gate 16. On the other hand, since the second standard pulse train would have already been stopped when the power was recovered, the time computing circuit 14 cannot use it to count the time information, the clock stops.

As understood from the foregoing, in the conventional power-failure-proof plug-in clock shown in FIG. 1, the relatively high frequency second standard pulse train must be generated even if the commercial power source is active, giving rise to noise in nearby television or radio receivers.

Therefore, when the conventional power-failure-proof clock is used in nearby association or combination with a television or radio receiver, there is the dilemma that the clock cannot be operated without either halting the second standard pulse train or generating undesirable noise in the television or radio receiver.

Another problem to be considered in improving the drawbacks inherent in the conventional electronic clock as mentioned above is how to prevent the number of connection pins from being increased when the clock circuit arrangement is fabricated as an integrated circuit.

Accordingly, an essential object of the present invention is to provide an electronic clock eliminating the noise problem caused by the auxiliary oscillator producing the second standard pulse train.

Another object of the present invention is to provide an electronic clock which enables either to stop the second standard pulse train while the commercial power is active and to produce correct time information at the time of recovery of the commercial power source.

Another object of the present invention is to provide an electronic clock having a circuit arrangement suitable for fabricating in the form of integrated circuit with reduced number of connection pins.

These and other objects and features of the present invention will be hereinafter fully described in conjunction with the preferred embodiments with reference to the attached drawings in which

BRIEF DESCRIPTION OF THE DRAWINGS

Referring to FIG. 4, there are provided a time computing circuit 14, a changeover circuit 30, a control circuit 40, a frequency divider 50 and an oscillator 60. The above mentioned components can be formed integrally within one chip as an intergrated circuit.

Figure 1:
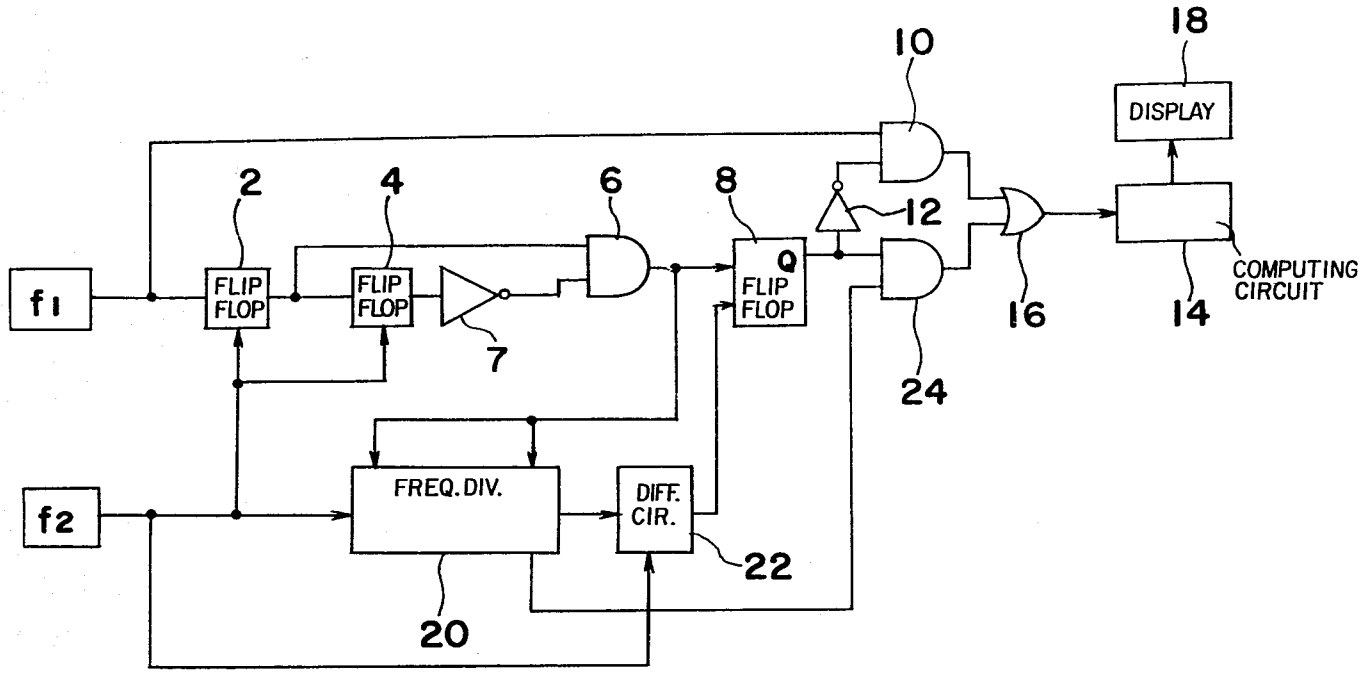
Fig. 1 (PRIOR ART)
FIG. 1 is a schematic diagram showing one example of a conventional plug-in electronic clock that can run during a power failure.
Figure 2:
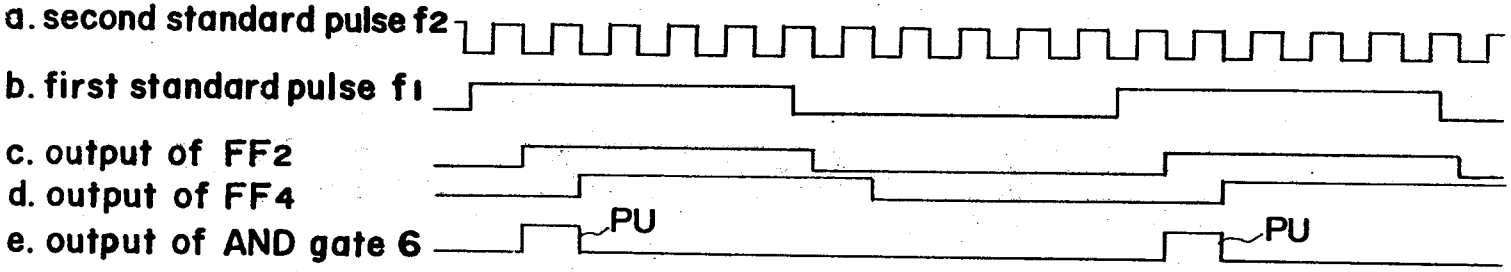
FIGS. 2*a* to 2*e* are various wave forms showing the operation of the conventional circuit arrangement shown in FIG. 1 when commercial power is being supplied.
Figure 3:
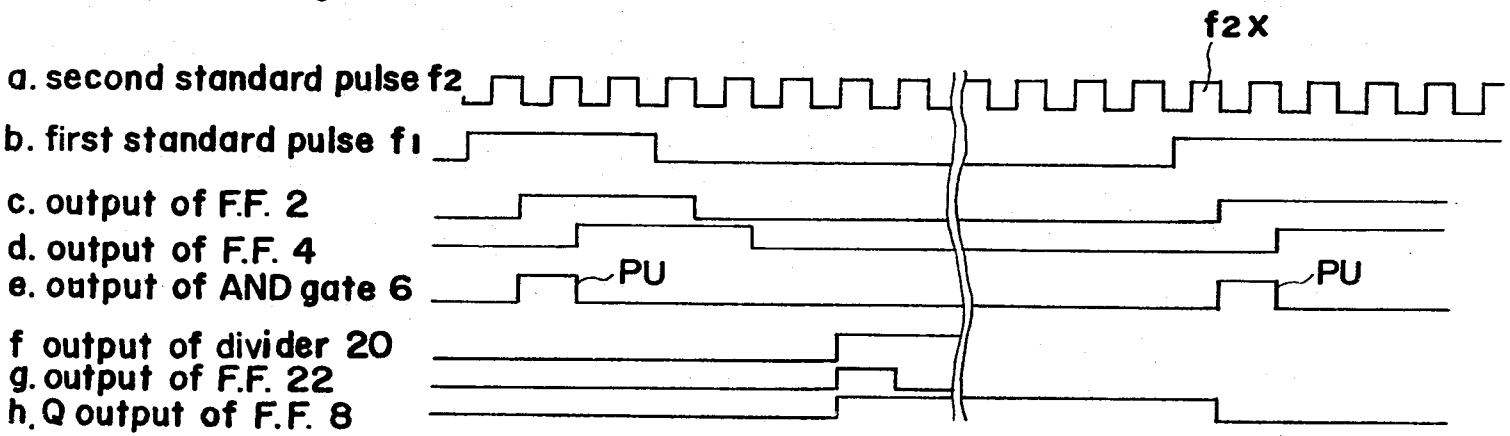
FIGS. 3*a* to 3*h* are various wave forms showing the operation of the circuit arrangement of FIG. 1 in a case where the commercial power fails and then is later recovered.

These components are driven by a D.C. power source fed from the terminal +B1 to which a D.C. power +B0 provided by rectifying the commercial power source, typically of 60 Hz or 50 Hz, is fed through the diode 71.

A battery 72 is connected to the terminal −B1 through a diode 73 so as to supply emergency D.C. power to the respective components in case of commercial power failure.

The time computing circuit 14 acts to count the number of pulses CL fed from the changeover circuit 30 to provide the various time information such as date, day of week, hour, minute, second, displaying them by the display device 18. The display device 18 is conventionally made by photo emissive diodes or a liquid crystal display device and displays such time information in digital form according to the time information fed from time computing circuit 14.

Change over circuit 30 is composed of an OR gate 31, AND gates 32 and 33 an inverter 34. The respective inputs of the OR gate 31 are connected with the outputs of AND gates 32 and 33. One input terminal of AND gate 32 receives the first standard pulse train f1 of 60 Hz which is derived from the commercial power source through a wave shaping circuit (not shown). On the other hand, one input terminal of AND gate 33 is connected with the output of the frequency divider 50. The output signal Sa produced from control circuit 40 is directly fed to the other input terminal of AND gate 33 and also indirectly fed to the other input terminal of AND gate 32 through inverter 34 so that changeover circuit 30 acts to change over the input to computing circuit 14 between either the first standard pulse train f1 (while the commercial power source is active) or the frequency divided second standard pulse train f2 from the frequency divider 50 (during the power failure) according to whether the signal Sa is "0" or "1".

The frequency divider 50 is composed of three flip-flops connected in series and serves to divide the frequency of the second standard pulses f2 produced from oscillator 60 into a replication of the commercial power frequency of the first standard pulse train f1. The respective outputs Ø1, Ø2 and Ø3 generated from each stage of said flip-flops are supplied to control circuit 40.

Control circuit 40 is composed of a R-S (reset-set) flip-flop 41, AND gates 42 and 43, an inverter 44 and a delaying circuit 45. AND gate 42 has its three inputs supplied with the outputs Ø1, Ø2 and Ø3 of frequency divider 50.

The output of AND gate 42 is connected with the "set" input terminal of flip-flop 41. AND gate 43, inverter 44 and delaying circuit 45 form a diferrential circuit for generation of pulses LE, each succeeding LE pulse being synchronized with the leading edge of a succeeding first standard pulse f1.

The output of AND gate 43 is connected with the respective "reset" terminals of flip-flop 41 and frequency divider 50 to reset both of them by each pulse LE. By this arrangement, flip-flop 41 is kept reset as long as the commercial power source is active by the pulse LE. But when the commercial power source is failed flip-flop 41 is set by the output pulse RT of AND gate 42.

Oscillator 60 comprises a capacitor C, resistors R1 and R2, inverters 61 and 62, a delaying circuit 63, a MOS transistor 64 and an NPN transistor 65. Resistor R1 is connected with capacitor C in series to form a charging circuit having a time constant defined by the respective values of resistor R1 and capacitor C. Resistor R1 is connected with terminal +B1 to receive the D.C. power source and the capacitor C is grounded at the end away from resistor R1. The non-grounded terminal of capacitor C, the source of the MOS transistor 64 and the collector of transistor 65 are connected in parallel. The base of transistor 65 is connected with the terminal +B0 through resistor R2.

Delaying circuit 63, composed of an RC delaying circuit having resistors and capacitors (not shown), has its input terminal connected with output of inverter 62. The input terminal of inverter 62 is connected with the junction point of resistor R1 and capacitor C to receive the voltage occurring across capacitor C.

The output of delaying circuit 63 is connected to the input of inverter 61 whose output is fed back to the gate of the MOS transistor 64 to provide the oscillation for generating the second standard pulse train f2 by an operation explanined hereafter. Assuming that MOS transistor 64 and transistor 65 are nonconductive, capacitor C is charged through resistor R1, the voltage across the capacitor C is increasing to a predetermined value or "1" level.

When the commercial power source is active, the outputs of the inverter 62 and the delaying circuit 63 are "1". But when the commercial power source becomes inactive, the capacitor C is charged up to the predetermined value or "1" level, the output of the inverter 62 is reversed to "0" from "1," in turn the output of the delaying circuit 63 becomes "0" delayed by the time defined by the time constant of the delaying circuit 63, resulting in changing the state of the inverter 61 to "1" from "0". The "1" output of inverter 61 is fed back to the gate of MOS transistor 64 to make MOS transistor 64 conductive or "ON." Then the charge held by capacitor C is discharged through MOS transistor 64 so that the potential of capacitor C is decreased to the ground level or "0" signal state.

Then the "0" signal of capacitor C is transferred forward to the output of inverter 61, with the time delay of delaying circuit 63, thereby causing MOS transistor 64 to once again become non-conductive, capacitor C then begins charging again. By successive repeating of this sequence of operation, an oscillation is continued to produce the second standard pulse train f2 at the output of inverter 61.

Said transistor 65 may be replaced by a MOS transistor wherein gate of the MOS transistor is connected to the resistor R2 with the source thereof connected to the resistor R1 and the drain grounded.

The operation of the electronic clock mentioned above is described herein-after.

As long as the commercial power source is active, the D.C. power +B0 is delivered by rectifying the commercial power source and the first standard pulse train f1 is fed to AND gate 32 and delaying circuit 45. Also, the D.C. power source +B0 is fed to the base of transistor 65 through resistor R2, so that the transistor 65 is held in the conductive state, stopping the build up of charge on the capacitor C, resulting in stopping of the oscillation of the second standard pulse train f2. Therefore, the output of frequency divider 50 is kept at a "0" as long as the commercial power is active.

Figure 5:
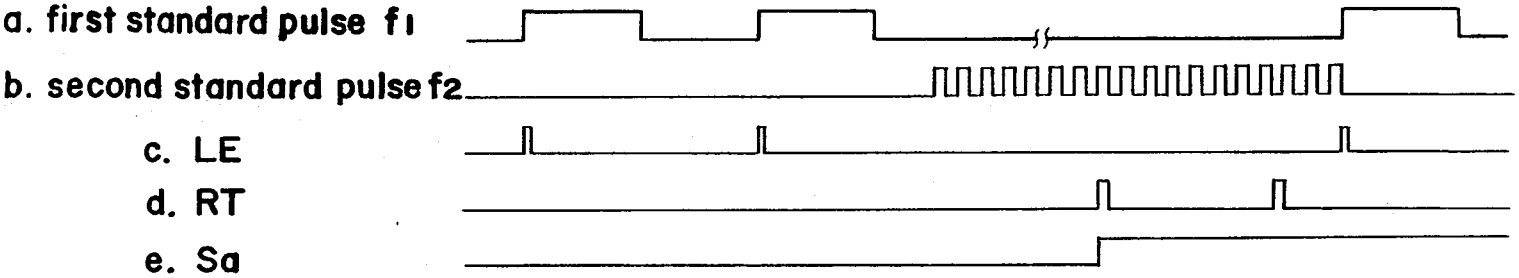
FIGS. 5*a* to 5*e* are various wave forms showing the outputs of the essential portions of the circuit arrangement shown in FIG. 4.

At the same time, while the commercial power source is active, the first standard pulse train f1 of commercial frequency, as shown in FIG. 5*a*, is generated from the pulse shaping circuit (not shown) and applied to AND gate 32 and the inputs of AND gate 43 and delaying circuit 45. When the first standard pulse becomes "1", AND gate 43 generates a pulse train LE as shown in FIG. 5*b*, each succeeding LE being synchronized with a leading edge of a corresponding succeeding pulse of standard pulse train f1. The width of a pulse LE is defined by the delaying time of delaying circuit 45.

Each pulse LE is fed to the "reset" terminal of flip-flop 41 so that the output Sa of flip-flop 41 is maintained at "0". Thus AND gate 33 is kept closed and the output of inverter 34 is a "1" so that AND gate 32 is open to allow the first standard pulse train f1 to pass to time computing circuit 14 through OR gate 31. Thus, the time information can be counted by the time computing circuit on the basis of the first standard pulse train f1 derived from the commercial power oscillations.

But in the case of a power failure, the first standard pulse train f1 and the D.C. power source +B0 disappear. Then transistor 65 is cut off and capacitor C can charge up with the current fed from the battery 72 through diode 73 and resistor R1, making it possible for oscillator 60 to oscillate to produce the second standard pulse train f2 as hereinbefore described. The pulses of the second standard pulse train f2 are fed to divider circuit 50 in which the second standard pulse train is divided to produce a timing pulse train replicating the frequency of the first standard pulse train f1.

On the other hand, an output RT is generated from AND gate 42 by the signals coming from the output terminals Ø1, Ø2 and Ø3 every time the divider 50 counts the predetermined number of pulses of the second standard pulses f2. The signal RT is fed to the flip-flop 1, setting it. When the flip-flop 41 is set, its output Sa becomes "1", thereby enabling AND gate 33 to pass the output of the divider circuit 50 to time computing circuit 14, while at the same time AND gate 32 is closed by the "0" signal produced by inverter 34. Thus, time computing circuit 14 computes the time information on the basis of the pulse output of the frequency divider 50, continuing the display of time on the display device 18 in spite of the power failure.

When the commercial power is recovered, the D.C. voltage +B0 is applied again to the base of transistor 65, causing transistor 65 to be conductive, which halts the charging of capacitor C, in turn halting the oscillation which produces the second standard pulse train f2. Since the commercial power has been recovered, the first standard pulse train f1 is once again applied to AND gates 42 and 43 and delaying circuit 45. Thus the resetting signal LE is generated by AND gate 43 as described before. This resets flip-flop 41, in turn making Sa, the output of flip-flop 41, a "0" so AND gate 32 receives a "1" and is opened to pass the first standard pulse train f1 to the time computing circuit 14 through OR gate 31.

It is an important advantage that control circuit 40 can detect whether or not the commercial power is active without using the second standard pulse train. Thus it becomes possible to stop the second standard pulse train while the commercial power is active, so that a radio or television set used nearby or with the power-failure-proof electronic clock of the present invention does not pick up interference noise caused by the relatively high frequency second standard pulse train f2.

Figure 6:
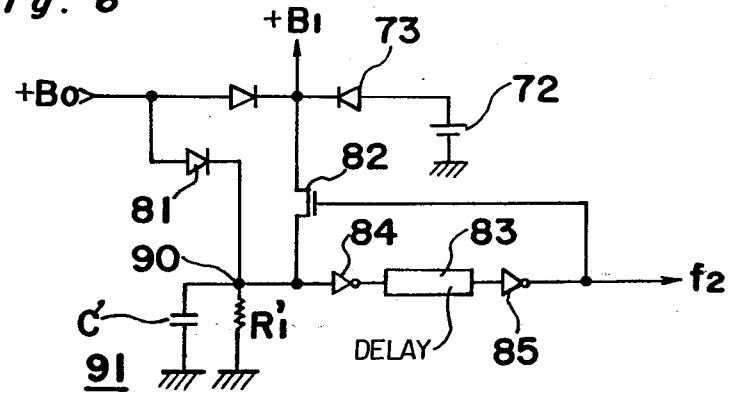
FIG. 6 is a schematic circuit diagram showing another embodiment of the oscillator circuit employed in the electronic clock according to the present invention.

FIG. 6 shows another embodiment of the oscillator circuit employed in the electronic clock according to the present invention in which a capacitor C' and a resistor R' are connected in parallel and one junction of the parallel RC circuit is grounded and the other junction 90 is connected with the +B0 input terminal through a diode 81 and the drain of a MOS transistor 82 the source of which is connected with −B1. The non-grounded terminal 90 of the RC circuit 91 is also connected with the input of a delaying circuit 83 through an inverter 84. The output of delaying circuit 83 is connected back to the gate of the MOS transistor 82 through an inverter 85.

The operation of the circuit arrangement shown in FIG. 6 is as follows;

In a case where the commercial power is active, it causes rectified D.C. power +B0 to be fed to capacitor C' and resistor R' through the diode 81. Since a constant dc current flows through resistor R' and a predetermined charge builds up on capacitor C'. Accordingly junction 90 of the RC circuit 91 is kept at a "1" level to stop the oscillation of the second standard pulse train f2. Under such state the MOS transistor 82 is nonconductive.

When the commercial power is lost, the effect caused by D.C. power source +B0 disappears from junction 90, and capacitor C' is discharged through resistor R' to a lower voltage, causing the signal applied to inverter 84 to be a "0". Then "1" output of inverter 84 is transferred, with a delay, by delaying circuit 93 to the input terminal of the inverter 85, causing it to output a "0".

When the output of the inverter 85 is changed to "0" from "1", MOS transistor 82 becomes conductive and applies the D.C. voltage from battery 72 through the diode 73, thus, the capacitor C' starts charging again to a voltage at the "1" level. The "1" signal of the charged capacitor C' is applied to inverter 84, thereby causing the output of inverter 85 to again become a "0" as described before, once again making MOS transistor 82 nonconductive, halting the charging of capacitor C'. By repeating this sequence, the desired second standard pulse train f2 can be obtained at the output terminal of the inverter 85 when the commercial power is lost. When the commercial power is recovered, the D.C. power source +B0 is applied to the capacitor C' through diode 81 continously charging it to a "1" level. Therefore, the oscillation of the second standard pulse train f2 is automatically stopped when commercial power is recovered.

Figure 4:
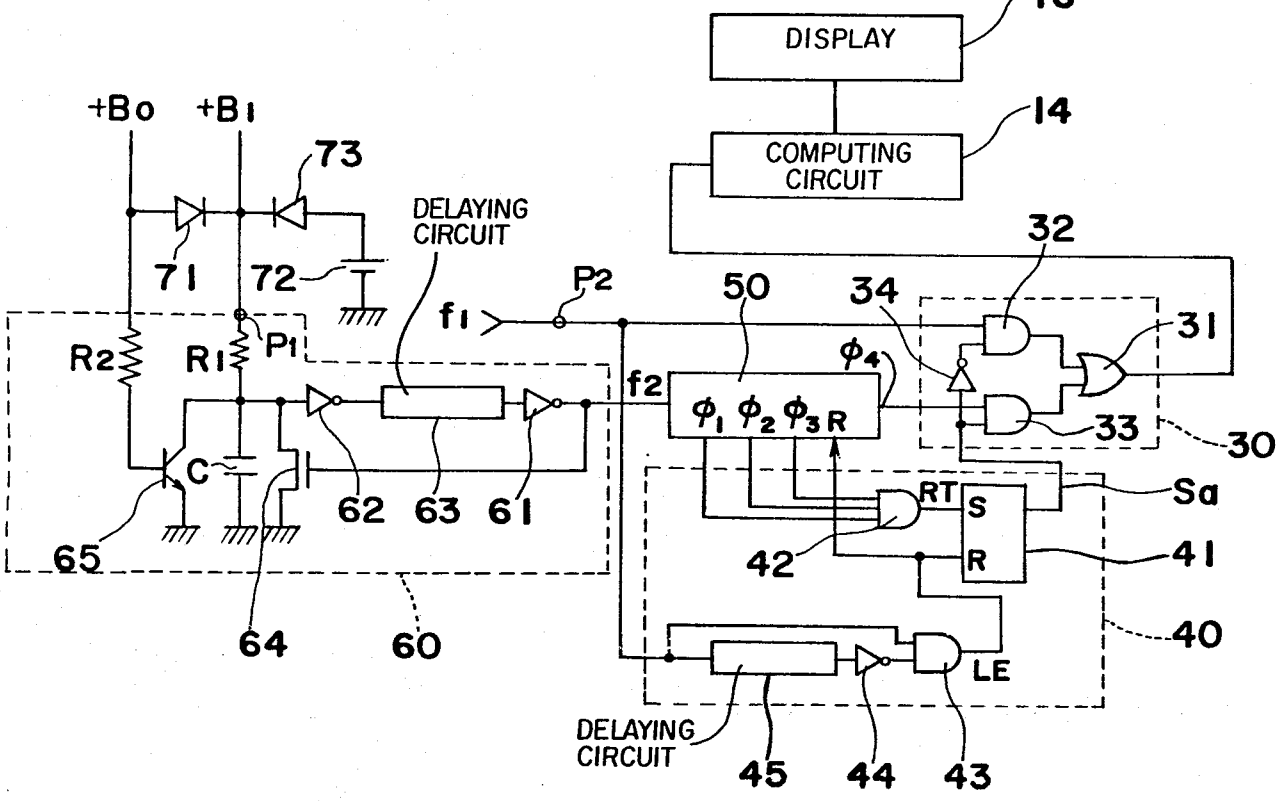
FIG. 4 is a schematic circuit diagram showing one embodiment of the electronic clock according to the present invention.

It is noted that in case of manufacturing the circuit arrangement of the present invention by an integrated circuit, so far as the input signal concerns, only two input pins P1 and P2 as shown in FIG. 4 are required, so that the number of connecting pins of the integrated circuit is not undesirably increased.

Although the present invention has been fully described by way of example with reference to the accompaying drawings, it is to be noted that various changes and modifications are apparent to those skilled in the art. Therefore, unless otherwise such changes and modifications depart from the scope of the present invention, they should be construed as included therein.

What is claimed is:

1. An electronic clock for coupling to a commercial power source comprising: means for generating a first standard pulse train having a commercial frequency derived from the commercial power source, a terminal $P_2$ for receiving said first standard pulse train, oscillating means for generating a second standard pulse train having an oscillation frequency higher than the frequency of the first standard pulse train said oscillating means including a resistor and a capacitor for forming a time constant circuit for defining the frequency of the second pulse train, wherein said resistor and capacitor are connected in series with a common terminal $P_1$ therebetween, dividing means, coupled to the output of said oscillating means, for dividing the frequency of the second standard pulse train into the frequency of the first standard pulse train, time computing means for computing the time information by counting the number of pulses fed from either the first standard pulse generating means or the frequency dividing means, display means, coupled to said time computing means, for displaying the time information in digital form in response to the time information, change-over means coupled to said terminal $P_2$ and to said frequency divider for selecting either the first standard pulse train from the terminal $P_2$ or the output pulses from the dividing means, said change-over means applying the selected pulse train to the time computing means; stopping means including an active switching element connected to said terminal $P_1$ for stopping the oscillation of the second standard pulse train when the commercial power source is active, control means coupled to the terminal $P_2$ and to the outputs of said dividing means for detecting and responding to the failure of the commercial power source, thereby causing the change-over means to apply the output of the pulses of the dividing means to the time computing means upon failure of the power source.

2. An electronic clock according to claim 1, wherein said stopping means comprises a transistor with the base thereof connected to the output terminal of a rectifying circuit for rectifying the commercial power source and the collector and the emitter thereof are connected with the oscillating means so that the transistor is switched on by the output of the rectifying circuit to halt the oscillation of the second standard pulse train while the commercial power source is active and the transistor is switched off to generate the second standard pulse train while the commercial power source is lost.

3. An electronic clock according to claim 1, wherein said stopping means is a diode one terminal of which is connected with the output terminal of a rectifying circuit for rectifying the commercial power source and the other terminal of which is connected with the capacitor provided in the oscillating means so that said capacitor is charged with the voltage fed through the diode from the rectifying circuit to halt the oscillation of the second standard pulse train while the commercial power source is active.

4. An electronic clock according to claim 1, wherein said active switching element of the stopping means comprises an MOS transistor with the gate thereof connected to the output terminal of a rectifying circuit for rectifying the commercial power source and the source and drain thereof are connected with the oscillating means for generating the second standard pulse train having said oscillation frequency higher than said first standard pulse train so that the MOS transistor is switched on by the output of the rectifying circuit to halt the oscillation of the second standard pulse train while the commercial power source is active and the MOS transistor is switched off to generate the second standard pulse train while the commercial power source is lost.

5. An electronic clock according to claim 1, where said change-over means comprises an OR gate, a pair of input terminals and a flip-flop circuit which is reset in synchronism with every leading edge of the first standard pulse train and being set by the signal fed from the frequency divider, a first AND gate receiving the first standard pulse train at one input terminal and the reversed signal of the set output of the flip-flop at another input terminal, a second AND gate receiving the output of the frequency divider at one input terminal and the set signal of the flip-flop at another input terminal so as to allow the output of the frequency divider and the OR gate to pass with the pair of input terminals connected with the outputs of the first AND gate and the second AND gate and the output connected with the input terminal of the time computing means.

6. An electronic clock comprising:

(a) clock means;

(b) an active first standard pulse train means for running said clock means having a first low frequency terminal the output of which is subject to inactivity due to a power failure;

(c) second standard pulse train means having a time constant circuit including a resistor, a capacitor and a second high frequency terminal the output of which charges the capacitor at an oscillation frequency whose time constant is defined by the respective values of the resistor and the capacitor to be higher than the oscillation frequency at the first terminal when the same is active;

(d) an active switching element connected to said second high frequency terminal for stopping the build-up of charge on the capacitor resulting in the stopping of the oscillation thereof when the first low frequency terminal is active;

(e) control means coupled to said first standard pulse train means, and said second standard pulse train means for detecting the inactivity of the first low frequency terminal without using the second standard pulse train; and (f) change-over means responsive to the detection of the inactivity of the first low frequency terminal by the control means for selectively running said clock means with the second standard pulse train means in case of a power failure that inactivates the first low frequency terminal.

7. The invention of claim 6 in which the second standard pulse train means, the active switching element, the control means and the change-over means are formed within one chip as part of an integrated circuit.

8. The invention of claim 7 in which the chip also includes a frequency divider for running the clock means from the second high frequency terminal at the oscillation frequency of the first low frequency terminal when the latter is active.

* * * * *